US005388610A

United States Patent [19]

Chuang

[11] Patent Number: 5,388,610

[45] Date of Patent: Feb. 14, 1995

[54] FLUSH VALVE FOR URINALS

[76] Inventor: Ming-Jung Chuang, No. 57, Sec. 3, Chang-Chin N Road, Taipei, Taiwan, Prov. of China

[21] Appl. No.: 243,926

[22] Filed: May 17, 1994

[51] Int. Cl.[6] ..... E03B 3/18

[52] U.S. Cl. ..... 137/549; 137/614.2; 251/40

[58] Field of Search ..... 251/40; 137/614.2, 614.19, 137/549

[56] References Cited

U.S. PATENT DOCUMENTS

| | | | |
|---|---|---|---|
| Re. 20,246 | 1/1937 | Binnall | 251/40 |
| 1,726,821 | 6/1930 | Fagan | 137/549 |
| 1,821,799 | 9/1931 | Grabler et al. | 251/40 |
| 4,913,182 | 4/1990 | Whiteside | 137/614.2 |

FOREIGN PATENT DOCUMENTS

| | | | |
|---|---|---|---|
| 9872 | 12/1933 | Australia | 251/40 |
| 502017 | 4/1951 | Belgium | 137/549 |
| 99108 | 12/1921 | Switzerland | 137/549 |

*Primary Examiner*—A. Michael Chambers
*Attorney, Agent, or Firm*—Bacon & Thomas

[57] ABSTRACT

The flush valve has in its inlet pipe of its main body a turnable knob, a hollow pipe-like filtering net provided on one side of an adjusting through hole opposite to an adjusting knob, and an elastic element and a pad provided inside the filtering net, water pressure will push away the pad and compress the elastic element to get into the filtering net for filtering out impurity in water and then get into the main body, when the valve is closed, the pad will cover the adjusting through hole by restoring force of the elastic element and the reversing water flow, the reversing hammering created by abrupt stopping of water will be absorbed by the pad, its pipe structure can thus be prevented from damage and leaking, the filtering net can be dismounted for cleansing and maintenance easily.

6 Claims, 8 Drawing Sheets

FLUSH VALVE FOR URINALS

BACKGROUND OF THE INVENTION

1. Field of the Invention

The present invention relates to the improvement in a flush valve for urinals, wherein a hollow pipe-like filtering net is provided at the side opposite to a water volume adjusting knob, an elastic element and a pad are provided in the central base portion of the filtering net to filter out impurity of water and to prevent the pipe structure from damage by reverse water hammering due to abrupt stopping of water.

2. Description of the Prior Art

A conventional flush valve for urinal (referring to FIG. 1) provides with an inlet pipe (11) extending rearwardly from a bowl-like main body (1), the inlet pipe (11) has on its top end a receiving hole (12) to receive an ajusting knob (2) having a soft plug. When water flows from the inlet pipe (11) to the main body (1), the volume of water can be adjusted with the adjusting knob (2), the main body (1) can receive a loading valve member (3), the receiving space can form a back pressure chamber (13) with an covering lid (31); The main body (1) further has a push button (4) on its front side for releasing water pressure formed in the back pressure chamber (13), an outlet (14) on the bottom end of the main body (1) is connected to a discharging pipe (5) with a screw; normally, the back pressure chamber (13) and the outlet (14) are separated by the loading valve member (3), while the back pressure chamber (13) is full of water to render the loading valve member (3) to seal the outlet (14), so that water from the inlet pipe (11) will not leak out from the outlet (14). When in use, the push button (4) can be pushed down (referring to FIG. 2) to open the loading valve member (3), so that the water in the back pressure chamber is driven out of the outlet (14) through a plurality of leaking holes (32) provided in the loading valve member (3), meantime, the pressure in the back pressure chamber (13) will be reduced due to leaking of water, and render the pressure of water source in the inlet pipe (11) to be larger than that of water in the back pressure chamber (13), and therefore raises the loading valve member (3) (as shown in FIG. 3), and water can flush out through the outlet (14). While during flushing, a small part of water can flow into the back pressure chamber (13) through the loading valve member (3), at the moment that the water in the loading valve member (3) accumulates for a period of time to render the water pressure in the loading valve member (3) to be larger than that of the pressure of flowing in water, the water pressure render the loading valve member (3) to lower to seal the outlet (14) again, so that water which originally flows out fluently through the outlet (14) will flow back due to accumulation thereof by the sealing of the loading valve member (3), a reverse water hammer is thereby formed and extended reversely to the pipe structure, this may easily damage a weak or old connection of pipe and make leaking, yet the leaking in the pipe is difficult to be cheked out for fixing, and hence is inconvenient for its user. Besides, the flush valve flushes by the pressure difference between the pressure in the back pressure chamber (13) on the top of the loading valve member (3) of the main body (1) and the pressure of flowing in water, if there is no device for filtering water with impurity, the impurity will destroy the above stated relation of pressure difference soon and render the urinal to have a non-stop leaking. Therefore, the conventional flush valve for urinals has to be improved. There is now in the market an automatic flushing device activated by a sensor via extra-red light, it is expensive in obtaining the automatic flushing and stopping water, yet no improvement is there in respect to the above mentioned defects. In view of this, the inventor of the present invention tested, studied, designed and improved for a long time against the defects resided in the conventional flush valve for a urinal and provides a novel flush valve for a urinal which can prevent from blocking and leaking of water, and prevent the pipe structure from being destroyed. In reality, a hollow pipe-like filtering net is provided at the side opposite to a water volume adjusting knob, and an elastic element and a pad are provided in the central base portion of the filtering net to get rid of the above mentioned defects.

SUMMARY OF THE INVENTION

Accordingly, the principal object of the present invention is to provide an improved flush valve for urinals, wherein a hollow pipe-like filtering net is provided on the upper side and surrounds the outer edge of an adjusting through hole and opposite to a water volume adjusting knob, a pad covers the adjusting through hole, and an elastic spring element is provided between the central base portion of the filtering net and the pad, so that the pad is slightly pressed downwardly against the adjusting through hole before activating of the flush valve, while if a user push down a push button to allow the water in a back pressure chamber flow down through a loading valve member, the pressure of the water source keeping on transporting forwardly will press the pad upwardly to let water get into the center of the filtering net, while when the water is filtered by the filtering net, the impurity of water will be intercepted, and thus filtering effect and preventing of the loading valve from blocking and leaking by impurity can be achieved.

The secondary object of the present invention is to provide an improved flush valve for urinal, wherein when the flush valve is activated, the pad will be held upward to press the elastic element by water pressure; and when the loading valve seals an outlet, stopping of forwarding water may render the pad to cover the adjusting through hole by the restoring force of the elastic element and the back pressure of the reversing water; the reversing hammering created by the abrupt stopping of water will not extend rearwardly, but is absorbed by the pad, so that the pipe structure can be prevented from damage by the hammering function, thus an object of protecting the pipe structure and prolonging its life may be achieved.

Another object of the present invention is to provide an improved flush valve for urinal, wherein the filtering net for intercepting impurity of water is provided on a turnable knob, when the impurity accumulated to quite an amount in the filtering net, a water volume adjusting knob can be closed and then the filtering net can be turned out for cleansing, a user can do a periodical maintenance by himself to get the aim of cleansing and maintenance.

The present invention will be apparent in re the realitical structure, characteristics and functions thereof after reading the detailed description of the preferred embodiment thereof in reference to the accompanying drawings.

DETAILED DESCRIPTION OF THE PREFERRED EMBODIMENT

Figure 1:
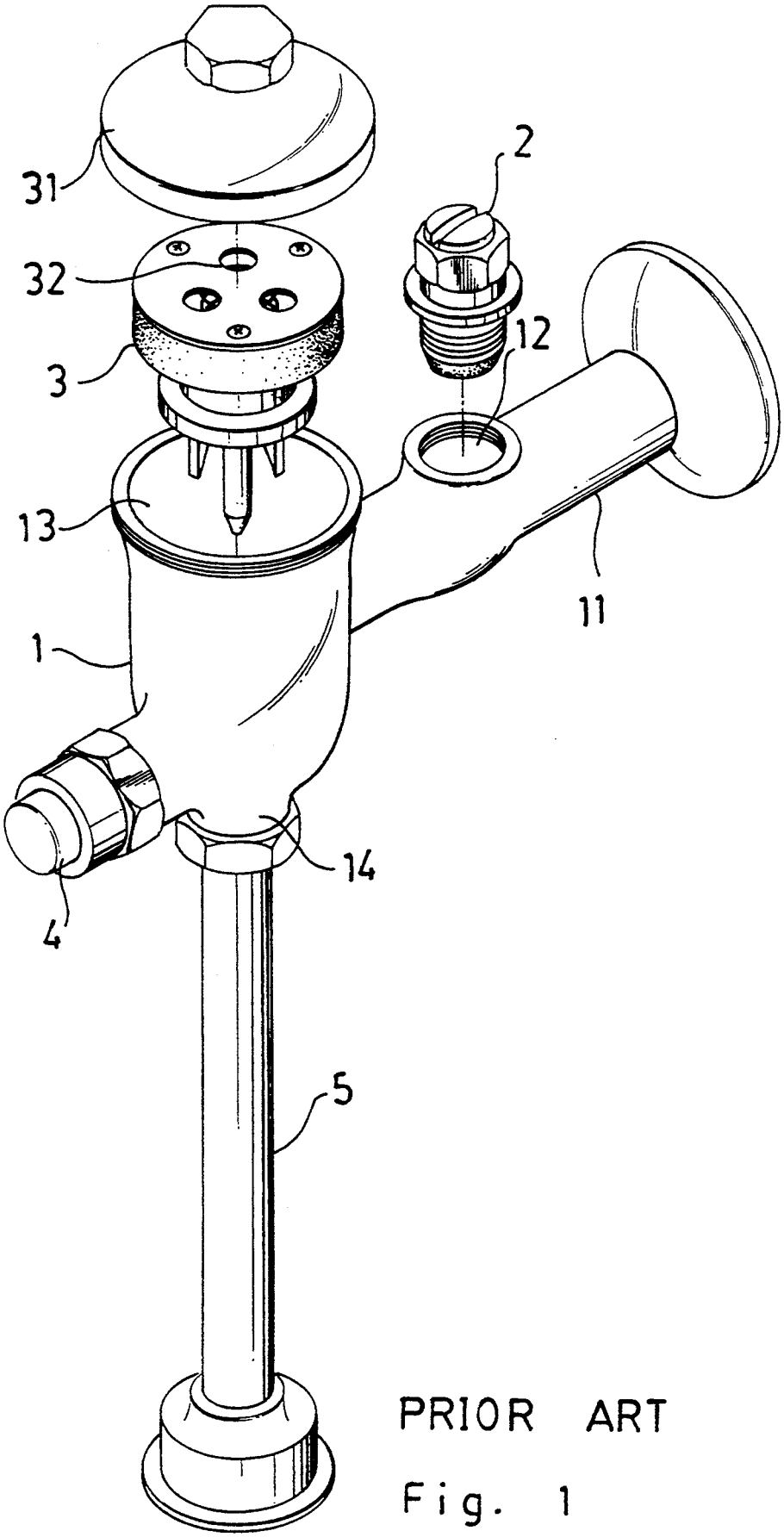
PRIOR ART Fig. 1
FIG. 1 is a perspective view of a conventional flush valve for a urinal.
Figure 2:
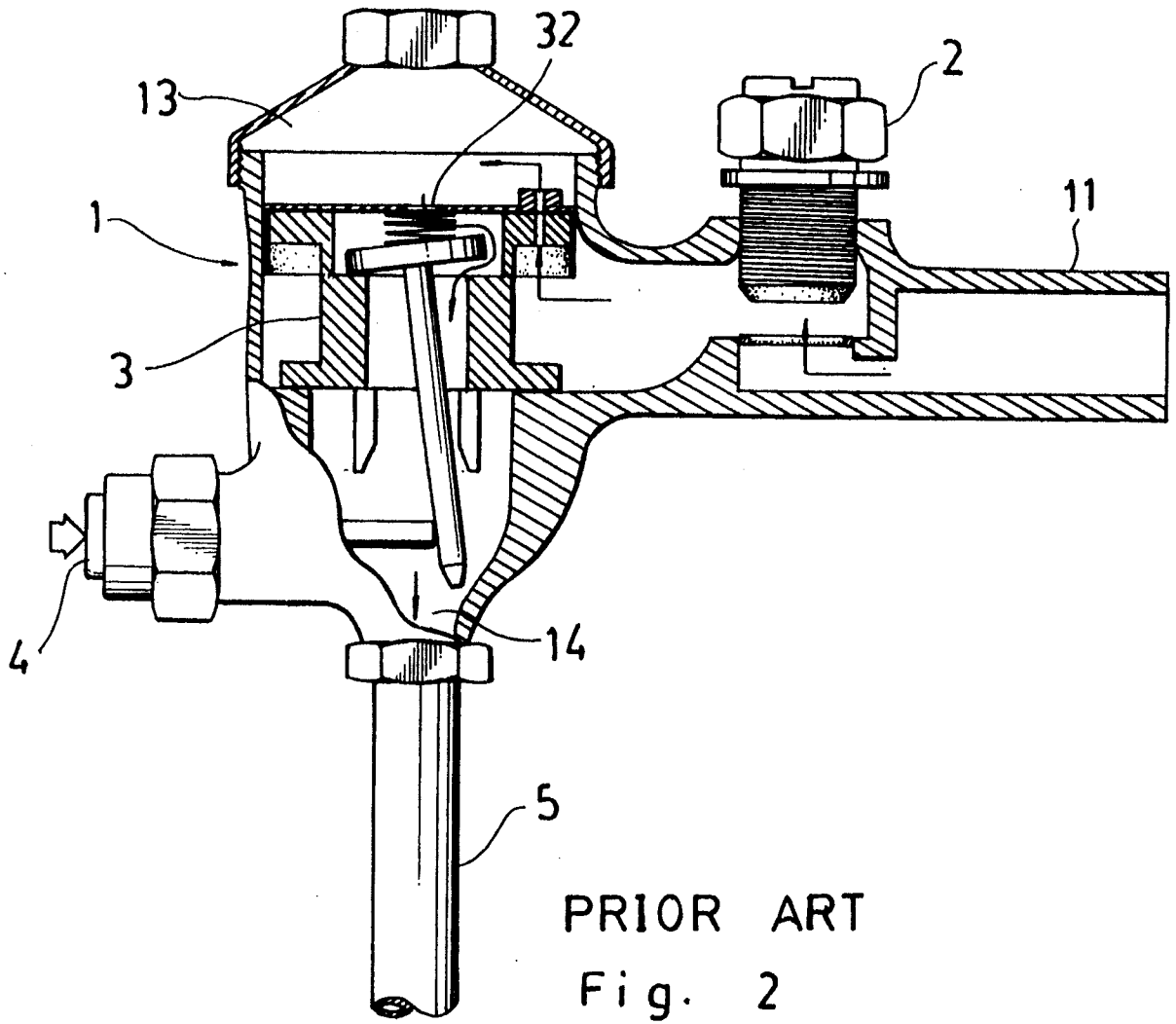
PRIOR ART Fig. 2
FIG. 2 is a schematic view of the flush valve in FIG. 1, showing the first activating step.
Figure 3:
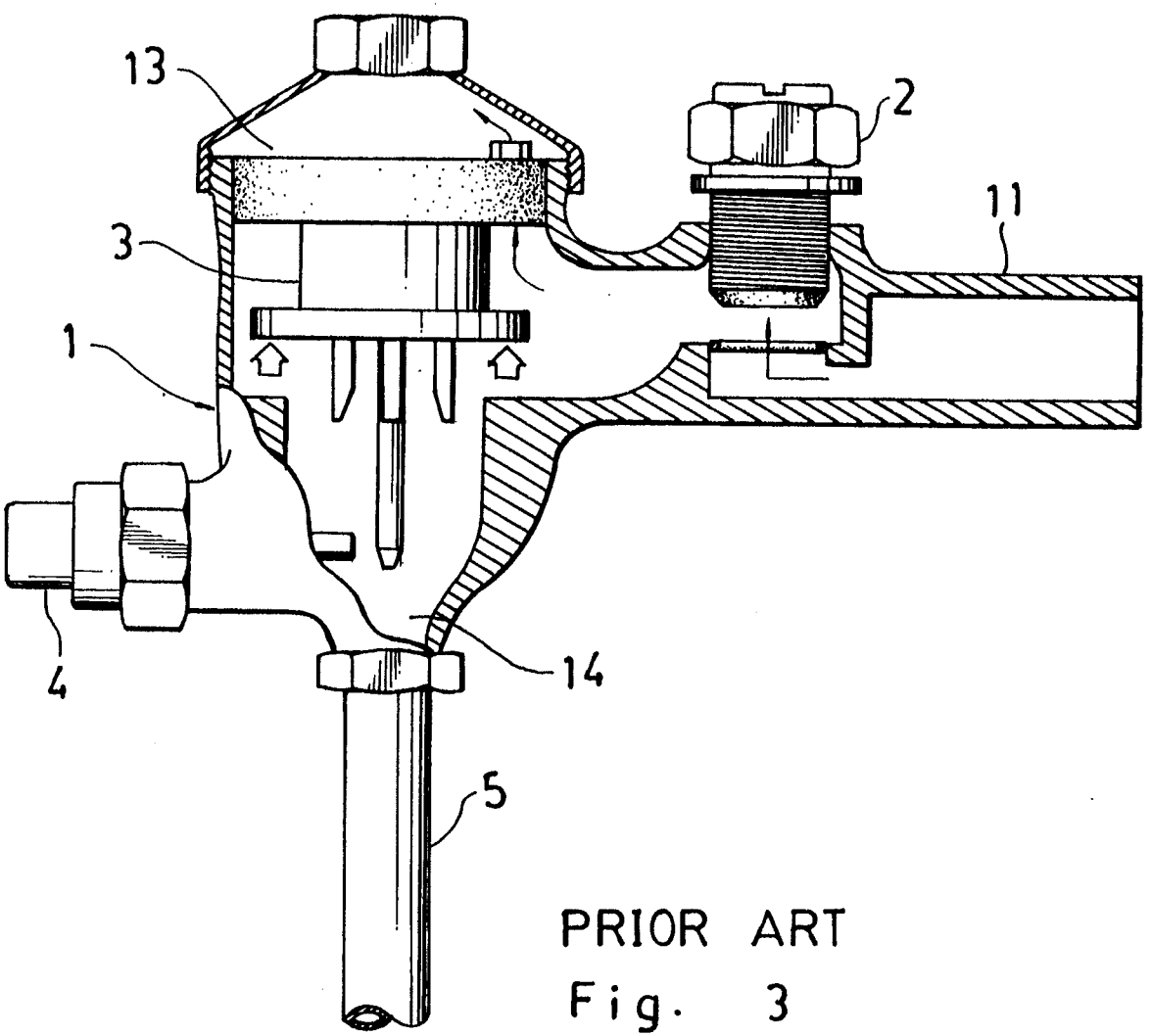
PRIOR ART Fig. 3
FIG. 3 a is schematic view of the flush valve in FIG. 1, showing the second activating step.
Figure 4:
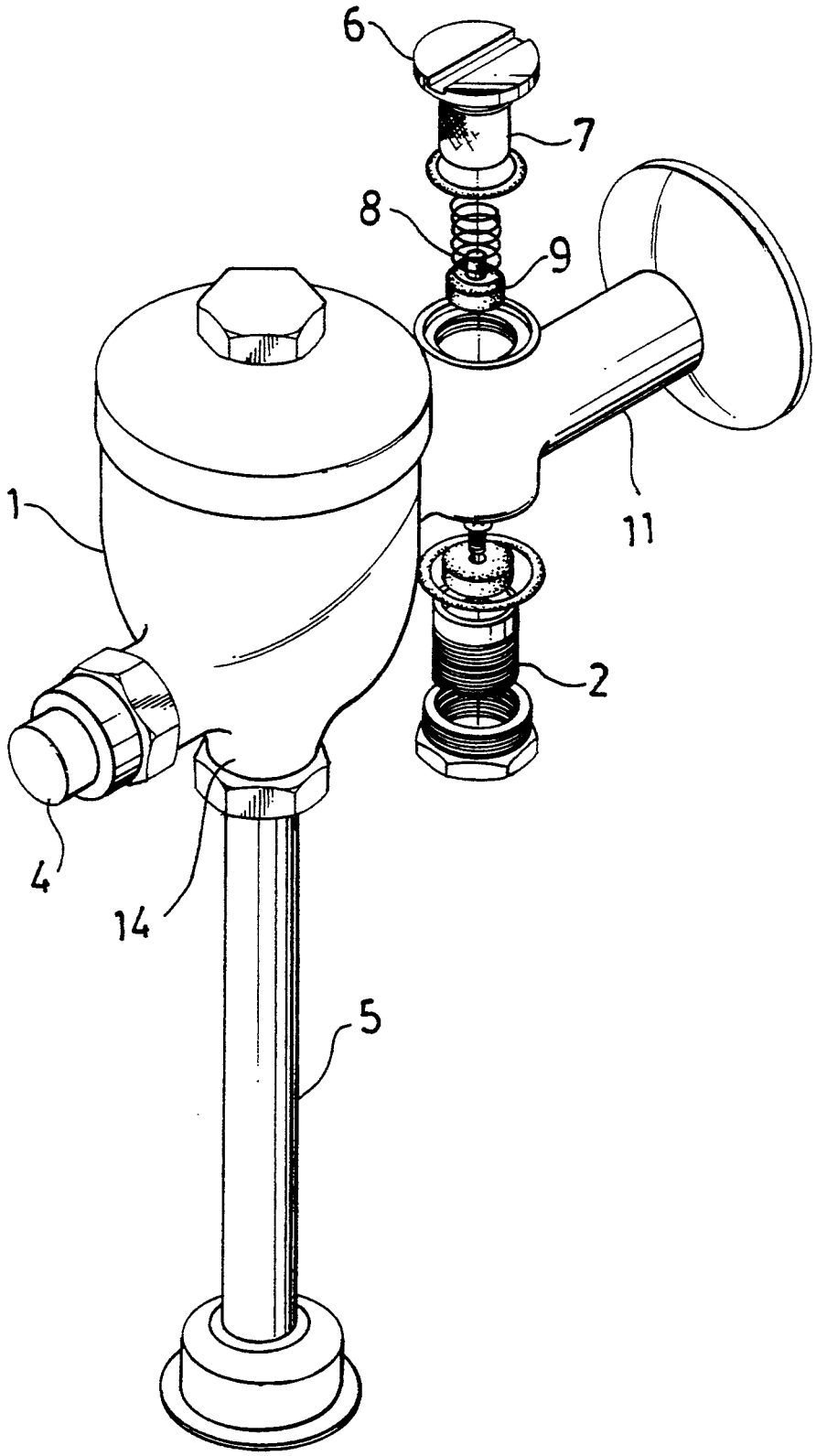
FIG. 4 is a perspective view of a flush valve of the present invention for a urinal.
Figure 5:
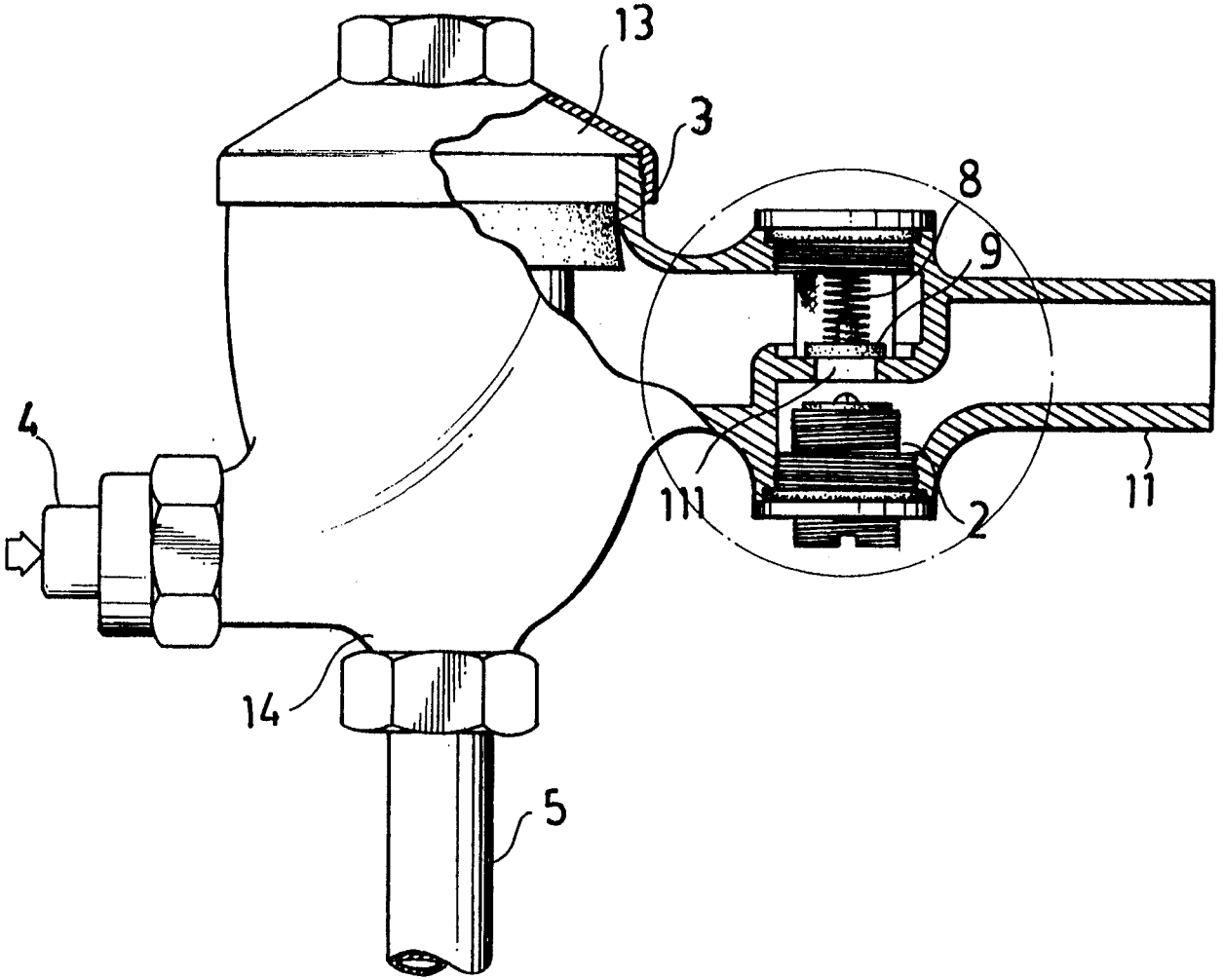
FIG. 5 is an exploded partial sectional view of the assembled embodiment of FIG. 4.
Figure 5A:
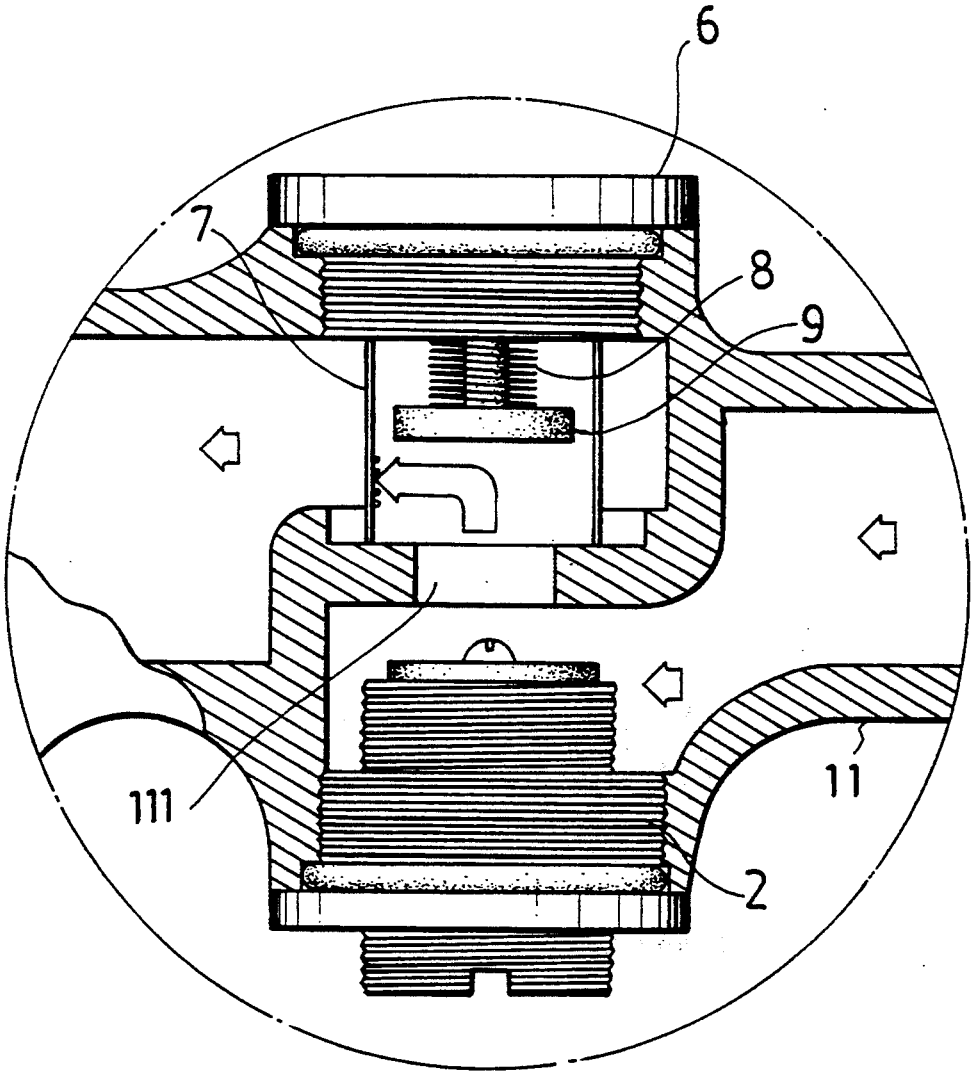
FIG. 5A is an enlarged sectional view of the sectional part as shown in FIG. 5, showing the pad of the present invention in a position for water flushing.
Figure 5B:
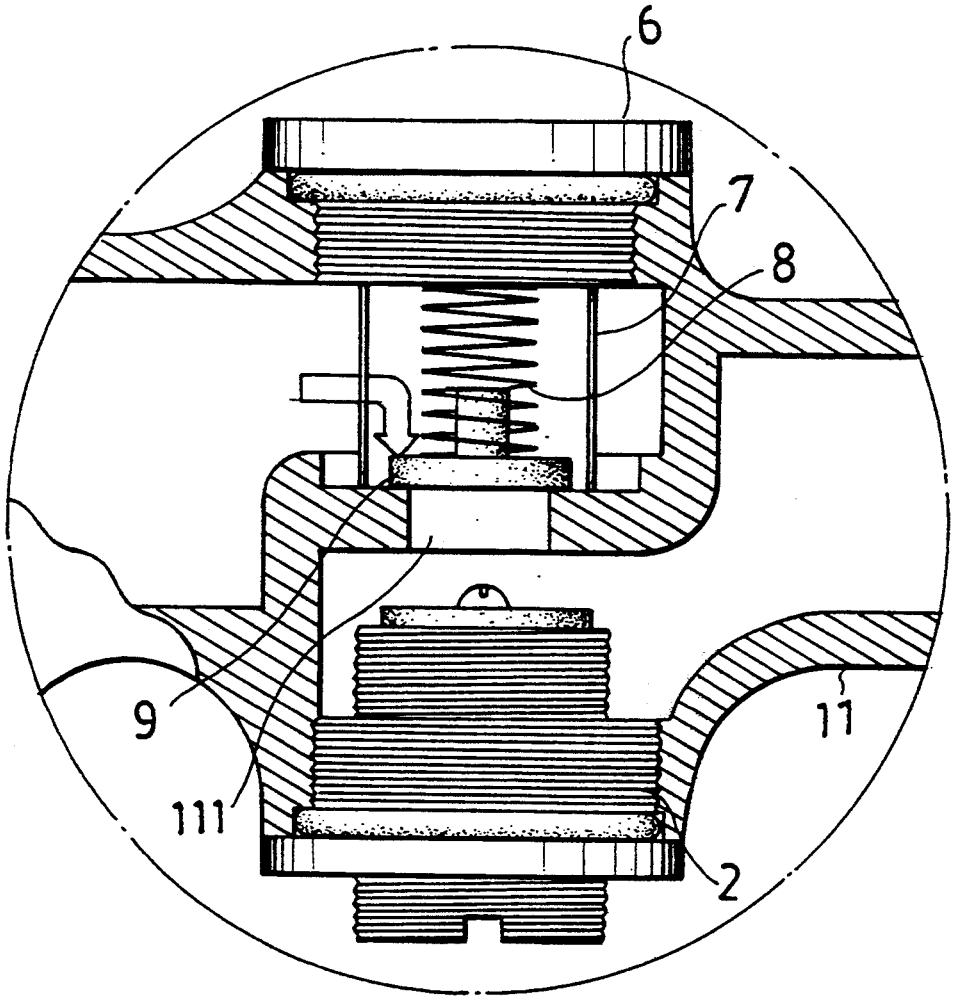
FIG. 5B is a similar view as FIG. 5A, showing the pad in a position for stopping water.

Referring to FIG. 4, it can be seen that the flush valve of the present invention for a urinal has a turnable knob 6, a hollow pipe-like filtering net 7, and an elastic spring element 8 and a pad 9 all provided in an inlet pipe 11 on one side of a main body 1 thereof, wherein the turnable knob 6 is screwed from outside into the inlet pipe 11, the hollow pipe-like filtering net 7 is fixed on the bottom end of the turnable knob 6, the pad 9 is provided in the central base portion of the filtering net 7, while the elastic spring element 8 is provided between the central base portion of the filtering net 7 and the pad 9; all the elements mentioned above are located opposite to an adjusting knob 2, and separated with the adjusting knob 2 by an adjusting through hole 111 (please refer to FIG. 5); the hollow pipe-like filtering net 7 surrounds the external edge of the adjusting through hole 111, the pad 9 slightly presses against the adjusting through hole 111 by the spring force of the elastic spring element 8; when other members of the main body 1 of the flush valve for the urinal are not activated in a normal situation, the pad 9 is in this condition of pressing against the adjusting through hole 111, if a user now push down a push button 4 as shown in FIG. 5 to release the sealing state of a loading valve member 3 in the main body 1 for allowing the water from the water source to flush out of a discharging pipe 5 through an outlet 14, the pressure of water can raise the pad 9 upwardly and get into the center portion of the filtering net 7 (please refer to FIG. 5A), meantime, the elastic spring element 8 is compressed thereby, water can keep clean through the filtering of the filtering net 7 and prevent the loading valve member 3 from being blocked and leaking; when the forwarding water is stopped, the pad 9 can cover again the adjusting through hole 111 by the restoring force of the elastic spring element 8 and the reverse water flow (FIG. 5B), so that the reversing hammering created by the abrupt stopping or blocking of water will not extend rearwardly, but is absorbed by the pad 9, the pipe structure can thus be prevented from damage by the hammering function, and an object of protecting the pipe structure and prolonging its life may be achieved.

Figure 6:
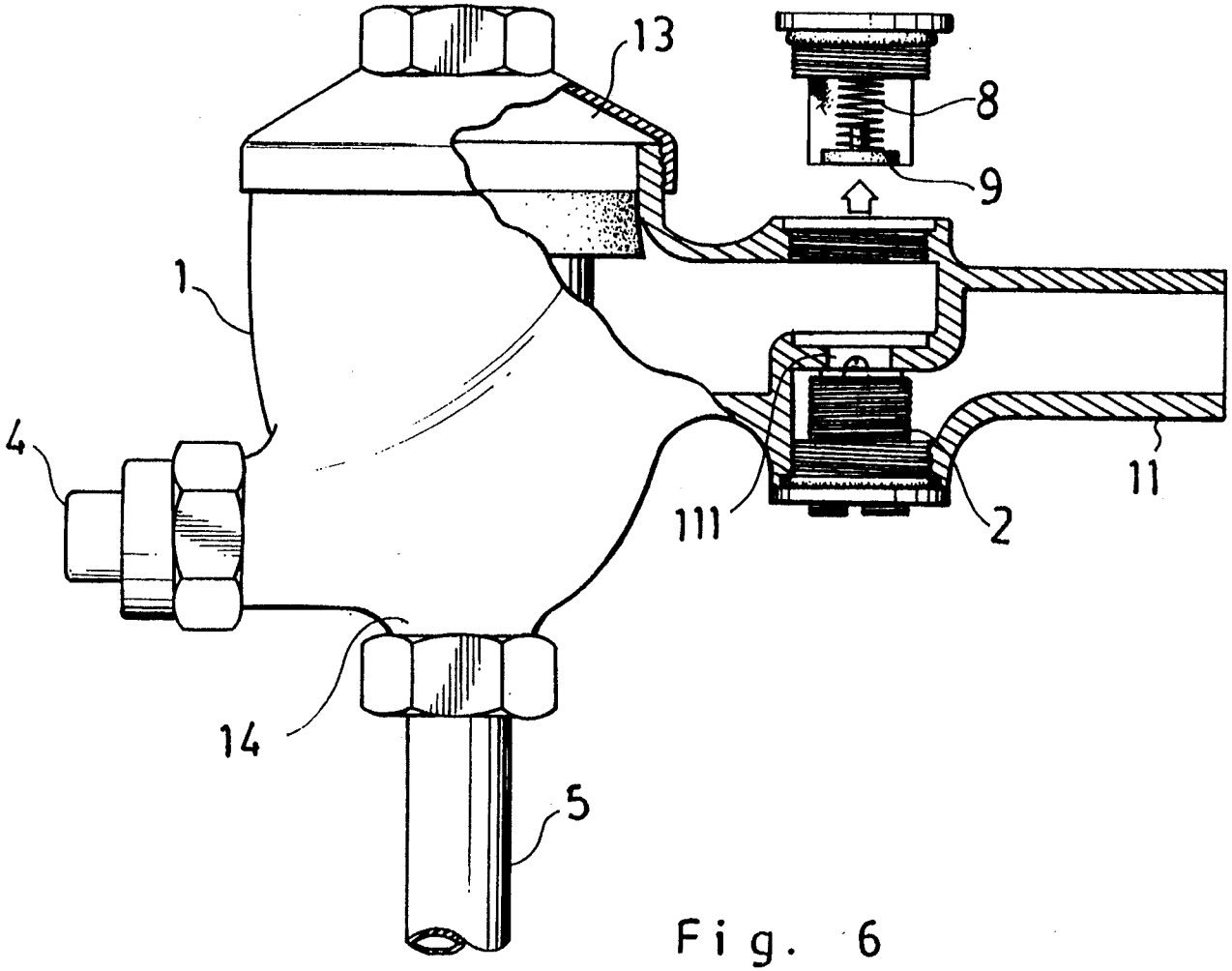
FIG. 6 is an exploded partial sectional view similar to FIG. 5, showing the filtering net is taken off from the adjusting knob of the present invent.

Further, when impurity of water intercepted by the filtering net 7 accumulates to quite an amount, the water volume adjusting knob 2 can be closed (as shown in FIG. 6) and then the filtering net 7 can be turned out together with the turnable knob 6 for cleansing, a user can do a periodical maintenance by himself to get the aim of cleansing and maintenance.

As a conclusion, the improved flush valve for urinals of the present invention provides additionally a turnable knob, a filtering net, an elastic spring element and a pad positioned opposite to the adjusting knob, so that the flush valve can filter out impurity in water and absorb the reverse hammering respectively during flushing and closing, yet the filtering net can further be dismounted for cleasing and maintenance, thus the defects resided in a conventional flush valve for urinals can be avoided.

My invention may assume numerous forms and is to be construed as including all modifications and variations falling within the scope of the appended claims.

I claim:

1. An improved flush valve for urinals comprising a bowl-like main body, a loading valve member within the interial of said main body, a covering lid on the top of said main body to form a back pressure chamber between said loading valve member and said covering lid, a push button provided on one side of said main body for releasing the sealed pressured state formed by said back pressure chamber and said loading valve member, an out let provided on the bottom end of said main body for connecting with a discharging pipe, and an inlet pipe provided on another side of said main body for supplying water, an adjusting knob screwed in said inlet pipe and abutted against the bottom of an adjusting through hole for adjusting volume of water flowing in, said flush valve is characterized in a plurality of elements therein, they are:

a hollow pipe-like filtering net provided on the upper side and surrounding the outer edge of said adjusting through hole and opposite to said water volume adjusting knob;

a turnable knob with its internal side being fixedly connected with one end of said filtering net, and with its outer section being screwed into said inlet pipe;

a pad provided inside said filtering net and above said adjusting through hole, and having enough area for covering said adjusting through hole; and an elastic element also provided inside said filtering net, and slightly abutting the central base portion of said filtering net where said filtering net and said turnable knob connect with each other and said pad respectively;

when flowing in water source being adjusted in volume with said adjusting knob passing through said adjusting through hole, the water pressure of the flowing in water being able to push said pad upwardly and compress said elastic element, to let water get into the center of said filtering net and flow out toward said main body, and when water flowing to said main body being abruptly stopped to render the pressure therein to be vanished, said pad covering over said adjusting through hole again by the restoring force of said elastic element and back flow of water, said pad thus absorbing the impact produced by hammering function of reversing water due to the abrupt closing of said main body, while said filtering net being capable of filtering out impurity in water.

2. An improved flush valve for urinals as stated in claim 1, wherein said main body is of the type like that on a conventional push-button type flush valve.

3. An improved flush valve for urinals as stated in claim 1, wherein said main body is of the type like that on an extra-red light type auto-flushing valve.

4. An improved flush valve for urinals as stated in claim 1, wherein the preferred material for said pad is rubber.

5. An improved flush valve for urinals as stated in claim 1, wherein said elastic element is a spring.

6. An improved flush valve for urinals as stated in claim 1, wherein said tunable knob, said filtering net, said elastic element and said pad are provided on said inlet pipe of said main body, said elastic element and said pad are located opposite to said adjusting knob and separated therefrom by said adjusting through hole.

* * * * *